US009194213B2

(12) United States Patent
Macleod et al.

(10) Patent No.: US 9,194,213 B2
(45) Date of Patent: Nov. 24, 2015

(54) PACKER

(75) Inventors: Iain Macleod, Newmachar (GB); Steve Reid, Aberdeen (GB)

(73) Assignee: PETROWELL LIMITED, Aberdeen (GB)

( * ) Notice: Subject to any disclaimer, the term of this patent is extended or adjusted under 35 U.S.C. 154(b) by 0 days.

(21) Appl. No.: 11/909,820

(22) PCT Filed: Apr. 10, 2006

(86) PCT No.: PCT/GB2006/001297
§ 371 (c)(1),
(2), (4) Date: Sep. 27, 2007

(87) PCT Pub. No.: WO2006/109031
PCT Pub. Date: Oct. 19, 2006

(65) Prior Publication Data

US 2008/0156500 A1 Jul. 3, 2008

(30) Foreign Application Priority Data

Apr. 9, 2005 (GB) ..... 0507237.6

(51) Int. Cl.
*E21B 23/06* (2006.01)
*E21B 33/1295* (2006.01)
*E21B 36/00* (2006.01)
*E21B 33/12* (2006.01)

(52) U.S. Cl.
CPC ..... *E21B 36/00* (2013.01); *E21B 33/12* (2013.01)

(58) Field of Classification Search
CPC . E21B 33/1292; E21B 23/06; E21B 33/1295; E21B 23/006; E21B 23/065; E21B 33/1291; E21B 33/12955
USPC ..... 166/119, 387
See application file for complete search history.

(56) References Cited

U.S. PATENT DOCUMENTS

| | | | |
|---|---|---|---|
| 643,358 | A | 2/1900 | Konold |
| 2,009,322 | A | 7/1935 | Emil |
| 2,181,748 | A | 11/1939 | Thaheld |
| 2,230,447 | A | 2/1941 | Bassinger |
| 2,498,791 | A | 2/1950 | Clark |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

PCT-GB2005-001391, Int'l Prelim. Report on Patentability, Jun. 23, 2005.

(Continued)

*Primary Examiner* — Shane Bomar
*Assistant Examiner* — Kipp Wallace
(74) *Attorney, Agent, or Firm* — Blank Rome LLP

(57) ABSTRACT

A packer for a well is described. The packer comprises at least one packing element, at least one anchoring element, and a mandrel coupled to the at least one anchoring element. The packer is arranged such that, once set, the mandrel is free to move with respect to the packing and anchoring elements. In one embodiment the at least one anchoring element is integral with the at least one packing element. In an alternative embodiment the at least one anchoring element is separate from the at least one packing element.

18 Claims, 7 Drawing Sheets

(56) References Cited

U.S. PATENT DOCUMENTS

| | | | | | |
|---|---|---|---|---|---|
| 2,546,377 | A | | 3/1951 | Turechek | |
| 2,738,018 | A | | 3/1956 | Lynes | |
| 2,832,418 | A | | 4/1958 | Baker | |
| 3,066,738 | A | | 12/1962 | Myers | |
| 3,087,552 | A | | 4/1963 | Graham | |
| 3,167,127 | A | | 1/1965 | Sizer | |
| 3,167,128 | A | | 1/1965 | Sutliff | |
| 3,283,821 | A | | 11/1966 | Brown | |
| 3,308,886 | A | * | 3/1967 | Evans | 166/134 |
| 3,342,268 | A | * | 9/1967 | Brown | 166/124 |
| 3,371,716 | A | | 3/1968 | Current | |
| 3,422,900 | A | * | 1/1969 | Holden et al. | 166/131 |
| 3,482,889 | A | | 12/1969 | Cochran | |
| 3,623,551 | A | | 11/1971 | Randermann | |
| 3,722,588 | A | * | 3/1973 | Tamplen | 166/123 |
| 3,729,170 | A | | 4/1973 | Lewis | |
| 3,861,465 | A | * | 1/1975 | Mignotte | 166/255.1 |
| 3,889,750 | A | | 6/1975 | Mullins | |
| 4,046,405 | A | | 9/1977 | Bonds | |
| 4,127,168 | A | | 11/1978 | Hanson | |
| 4,317,485 | A | | 3/1982 | Ross | |
| 4,331,315 | A | | 5/1982 | Geisow | |
| 4,346,919 | A | | 8/1982 | Morrill | |
| 4,375,240 | A | * | 3/1983 | Baugh et al. | 166/387 |
| 4,479,548 | A | * | 10/1984 | Gilbert | 166/387 |
| 4,588,030 | A | | 5/1986 | Blizzard | |
| 4,917,187 | A | | 4/1990 | Burns | |
| 5,010,958 | A | | 4/1991 | Meek et al. | |
| 5,058,684 | A | | 10/1991 | Winslow | |
| 5,095,978 | A | * | 3/1992 | Akkerman et al. | 166/120 |
| 5,261,488 | A | | 11/1993 | Gullet | |
| 5,404,944 | A | | 4/1995 | Lynde et al. | |
| 5,487,427 | A | | 1/1996 | Curington | |
| 5,542,473 | A | * | 8/1996 | Pringle | 166/120 |
| 5,862,861 | A | | 1/1999 | Kalsi | |
| 6,062,309 | A | | 5/2000 | Gosse | |
| 6,315,041 | B1 | | 11/2001 | Carlisle | |
| 7,690,424 | B2 | | 4/2010 | MacLeod | |
| 2003/0000607 | A1 | | 1/2003 | Jenner | |
| 2004/0055757 | A1 | | 3/2004 | Beall | |
| 2005/0224227 | A1 | | 10/2005 | Hendrie | |
| 2007/0017683 | A1 | | 1/2007 | O'Malley | |
| 2009/0200042 | A1 | | 8/2009 | Emerson | |
| 2009/0308592 | A1 | | 12/2009 | Mercer | |

FOREIGN PATENT DOCUMENTS

| | | |
|---|---|---|
| EP | 0453052 | 10/1991 |
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO02/42672 | 5/2002 |
| WO | WO 2005/026494 | 3/2005 |
| WO | WO2005121498 | 12/2005 |
| WO | WO 2006/046075 | 5/2006 |
| WO | WO 2007/109878 | 10/2007 |

OTHER PUBLICATIONS

PCT-GB2005-001391, International Search Report, Jun. 23, 2005.
PCT-GB2005-001391, Written Opinion, Jun. 23, 2005.
PCT-GB2005-004200, Written Opinion, Apr. 10, 2006.
PCT-GB2005-004200, Int'l Prelim. Report on Patentability, May 1, 2007.
PCT-GB2005-004200, International Search Report, Jan. 11, 2006.
PCT-GB2005-003871 Int'l Prelim. Report on Patentability, Sep. 11, 2007.
PCT-GB2005-003871, International Search Report, Nov. 17, 2005.
11/816421-OA-20090330, Office Action dated Mar. 30, 2009, Applicant's co-pending U.S. Appl. No. 11/816,421.
11/816421-OA-20090928, Office Action dated Sep. 28, 2009, Applicant's co-pending U.S. Appl. No. 11/816,421.
PETR103-OA-UK-20051101, Foreign Office Action dated Nov. 1, 2005.
PCT-GB2005-003871, Written Opinion, Nov. 22, 2005.
PCTGB2006001297, International Search Report, Oct. 9, 2007.
PCTGB2007001040, International Search Report, Jun. 5, 2010.
PCTGB2007001040, Int'l Prelim. Report on Patentability and Written Opinion, Sep. 23, 2008.
PCTGB2007004372, Int'l Prelim. Report on Patentability and Written Opinion, May 19, 2009.
PCTGB2007004372, International Search Report, Jan. 23, 2008.
PCTGB2008002042, Int'l Prelim. Report on Patentability and Written Opinion, Dec. 20, 2009.
PCTGB2008002042, International Search Report, Oct. 17, 2008.
PCTGB2009071874, Int'l Prelim. Report on Patentability and Written Opinion, Jun. 8, 2010.
PCTGB2009071874, International Search Report, Jul. 23, 2009.
PCT-GB2008003883, Int'l Prelim. Report on Patentability and Written Opinion, May 25, 2010.
PCTGB2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
11/577866-PETR102-OA-08-25-2010, Office Action dated Aug. 25, 2010, Applicant's co-pending U.S. Appl. No. 11/577,866.
Pursuant to MPEP § 2001.6(b) applicants bring the following co-pending application to the Examiner's attention: U.S. Appl. No. 12/866,495.
Pursuant to MPEP § 2001.6(b) applicants bring the following co-pending application to the Examiner's attention: U.S. Appl. No. 12/743,397.
Pursuant to MPEP § 2001.6(b) applicants bring the following co-pending application to the Examiner's attention: U.S. Appl. No. 12/743,505.
Pursuant to MPEP § 2001.6(b) applicants bring the following co-pending application to the Examiner's attention: U.S. Appl. No. 12/665,641.
Pursuant to MPEP § 2001.6(b) applicants bring the following co-pending application to the Examiner's attention: U.S. Appl. No. 12/514,488.
Pursuant to MPEP § 2001.6(b) applicants bring the following co-pending application to the Examiner's attention: U.S. Appl. No. 12/294,078.
Pursuant to MPEP § 2001.6(b) applicants bring the following co-pending application to the Examiner's attention: U.S. Appl. No. 11/816,421.
Pursuant to MPEP § 2001.6(b) applicants bring the following co-pending application to the Examiner's attention: U.S. Appl. No. 11/577,866.
Pursuant to MPEP § 2001.6(b) applicants bring the following co-pending application to the Examiner's attention: U.S. Appl. No. 11/570,335.
International Search Report for PCT/GB2009/000730, Sep. 24, 2009.
Written Opinion for PCT/GB2009/000730, Sep. 18, 2010.
Office Action, Applicant's co-pending U.S. Appl. No. 11/909,820, Oct. 7, 2010.
International Search Report for PCT/GB2009/000770, Oct. 8, 2009.
Written Opinion for PCT/GB2009/000770, Sep. 29, 2010.
Pursuant to MPEP § 2001.6(b) applicants bring the following co-pending applications to the Examiner's attention: U.S. Appl. No. 12/933,053, and U.S. Appl. No. 12/933,015.
Search Report, GB1110379.3, dated Jun. 30, 2011 from United Kingdom Intellectual Property Office.
Office Action dated Nov. 2, 2011, copending U.S. Appl. No. 12/294,078.
Written Opinion of the International Searching Authority, Oct. 9, 2007.
International Preliminary Report on Patentability, Oct. 9, 2007.

* cited by examiner

PACKER

The present invention relates to packers and particularly to packers for forming a seal with a formation surface.

In an oil well it is often necessary to seal a section of the annulus between the formation surface and a tubular conduit, or between the casing or liner and a tubular conduit. Packers are widely used to create such a seal.

Packers generally employ a packing element to form the seal, and an anchoring element to anchor the packer in place. The anchoring element can be separate from the packing element or it can be formed integrally with the packing element.

Anchoring a packer securely, and in particular anchoring securely to a formation surface can be difficult. Care must be taken to avoid causing excessive damage to the formation surface, because if the rock becomes overstressed it can fracture, potentially increasing the bore of the hole and thereby increasing the difficulty of providing an acceptable seal.

Conventional packers for sealing against a formation surface utilise a rubber inflatable element or an element which swells in the presence of well fluids. In either case, the element engages the rock surface and relies on seal friction between the element and the formation surface to provide the anchor.

Conventional packers, however, have associated drawbacks. Once installed a substantial pressure differential can exist across the element that can result in movement of the element, which, in turn, can cause mechanical wear, resulting in damage to the element. In the case of an inflatable element, such damage can permit a liquid inflation medium to leak out.

Movement of the packer element can also be caused by thermal expansion and/or contraction of component parts of the packer as the temperature fluctuates within the well. Expansion and contraction of this type can exert substantial forces on the packer which may prevent the packer from operating optimally, and, in some cases, cause damage to the formation surface.

It is an object of the present invention to obviate or mitigate at least one of the aforementioned disadvantages.

According to a first aspect of the present invention there is provided a packer for a well comprising:

at least one packing element;

at least one anchoring element, and a mandrel coupled to the at least one anchoring element, wherein, once set, the mandrel is free to move with respect to the packing and anchoring elements.

For the avoidance of doubt, "anchoring element" means a component, the purpose of which is to substantially secure a packer in a well and prevent axial movement of the packer along the well. In one embodiment the anchoring element may be integral with the packing element, however in an alternative embodiment the anchoring element may be separate from the packing element.

The provision of a packer with a mandrel that is free to move with respect to the packing and anchoring elements, allows the mandrel, in use and once the packer is set, to move in response to thermal changes occurring within the well without adversely affecting the seal or anchor formed by the other packer components.

Preferably, the mandrel can move axially up and/or down the well with respect to the packing and anchoring elements. In a deviated well, "up" the well is towards the surface.

Preferably, the mandrel can move axially by approximately 450 mm (18 inches) either up or down the well. Alternatively, any suitable axial movement can be accommodated.

Preferably, the packer further includes an interlock mechanism for controlling the setting of the packing and anchoring elements.

The interlock may be configured to prevent the packer from setting until a predetermined pressure is applied to the interlock. The purpose of the interlock is to prevent the packer from setting prematurely in the wrong location.

The mandrel may include a port through which a pressure of sufficient magnitude to trip the interlock and set the packer can be applied. Pressure can be applied through the port by pressurising the well or by using a setting sub. Alternatively, any suitable remote actuation device could be used to initiate setting of the packer.

Where the at least one packing element and the at least one anchoring element are integral, the interlock may comprise:

a deactivation element configured to move with respect to the mandrel upon application of a predetermined pressure;

a packer setting sleeve configured to move with respect to the mandrel from a packer run-in position to a packer set position;

a plurality of packer setting sleeve dogs for releasably retaining the packer setting sleeve in the packer run-in position; and a plurality of mandrel dogs for releasably retaining the mandrel with respect to the at least one integral packing/anchoring elements until said packing/anchoring elements are set.

In a preferred embodiment the at least one anchoring element is separate from the at least one packing element.

The provision of an anchoring element which is separate from the packing element provides an anchor which can withstand substantial differential pressures across the packer.

Most preferably, the at least one anchoring element comprises a formation engaging member of the type described in the Applicant's co-pending International patent application PCT/GB2005/003871.

Where the at least one packing element and the at least one anchoring element are separate, the interlock may comprise:

a deactivation element configured to move with respect to the mandrel upon application of a predetermined pressure;

an anchoring element setting sleeve configured to move with respect to the mandrel from an anchoring element run-in position to an anchoring element set position;

a plurality of anchoring element setting sleeve dogs for releasably retaining the anchoring element setting sleeve in the anchoring element run-in position;

a packing element setting sleeve configured to move with respect to the mandrel from a packing element run-in position to a packing element set position;

a plurality of packing element setting sleeve dogs for releasably retaining the packing element setting sleeve in the packing element run-in position; and a mandrel dog for releasably retaining the mandrel with respect to the packing and anchoring elements until said packing and anchoring elements are set.

Preferably, the at least one packing element is an elastomer element. The elastomer element may be a nitrile rubber. Most preferably, the elastomer element is solid. Using a solid elastomer element is advantageous because a pressure differential across the element acts to squeeze the element towards the surface against which the seal is to be made, further improving the seal.

Alternatively, the at least one packing element is in the form of a cup seal of the type described in PCT/GB2005/001391. Such a seal provides a high degree of expansion is useful for open hole applications.

The seal surface of the at least one packing element may comprise alternate ridges and troughs. The ridges and troughs assist in accommodating the compressibility of the at least one packing element.

The at least one packing element may comprise a series of overlapping seal back-ups. Overlapping seal back-ups can be provided to prevent axial extrusion of the at least one packing element.

According to a second aspect of the present invention there is provided a method of setting a packer in a well, the method comprising the steps of:

expanding at least one integral packing/anchoring element outwardly from a mandrel from a run-in configuration to create a set configuration with a surface of the well; and actuating the packer to free the mandrel to allow said mandrel to be moveable with respect to the packing and anchoring elements.

According to a third aspect of the present invention there is provided a method of setting a packer in a well, the method comprising the steps of:

expanding at least one anchoring element outwardly from a mandrel from a run-in configuration to create an anchored configuration with a surface of the well;

expanding at least one packing element outwardly from the mandrel from a run-in configuration to create a sealed configuration with a surface of the well; and actuating the packer to free the mandrel to allow said mandrel to be moveable with respect to the packing and anchoring elements.

By virtue of the present invention there is provided a packer for a well in which the mandrel can move in response to thermal changes within the well without affecting the integrity of the packer seal.

The present invention will now be described, by way of example, with reference to the accompanying figures in which.

Figure 1:
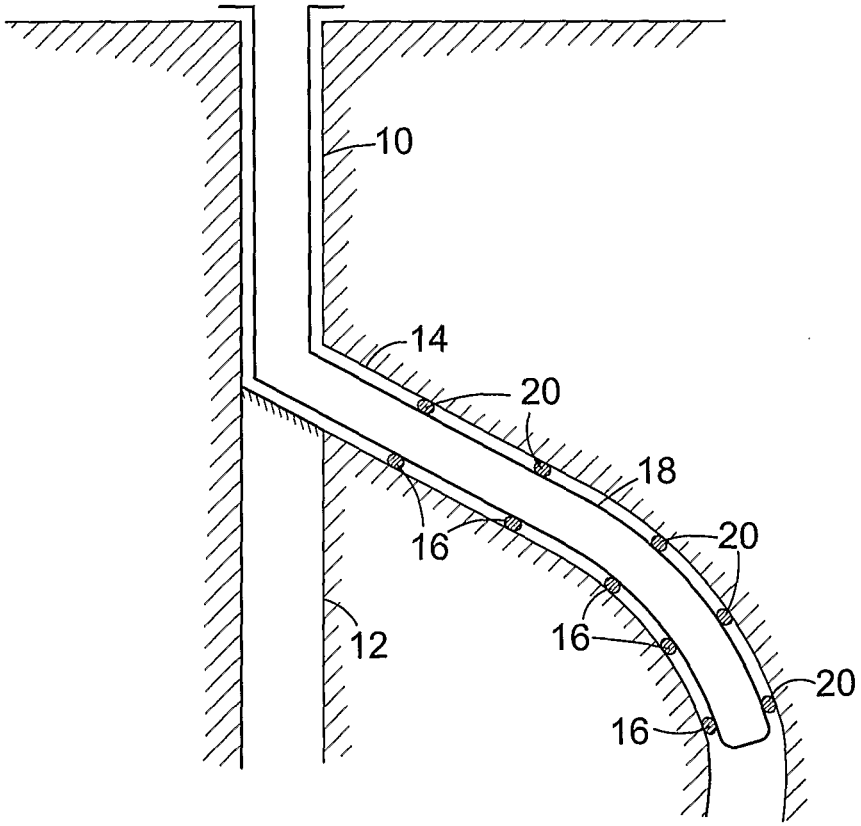
FIG. 1 is a schematic sectional view of a well including a number of packers in accordance with a preferred embodiment of the present invention.

Referring firstly to FIG. 1, there is shown a schematic view of a well, generally indicated by reference numeral 10, including a number of packers in accordance with a preferred embodiment of the present invention. The lower portion 12 of the well 10 has been abandoned and a new deviated bore 14 has been drilled.

The deviated bore 14 includes a series of packers 20, with adjacent packers 20 isolating a formation zone 16. The well tubing 18 between adjacent packers 20, may be perforated, and operations such as injecting water into the formation zone 16 may be performed.

Figure 2A:
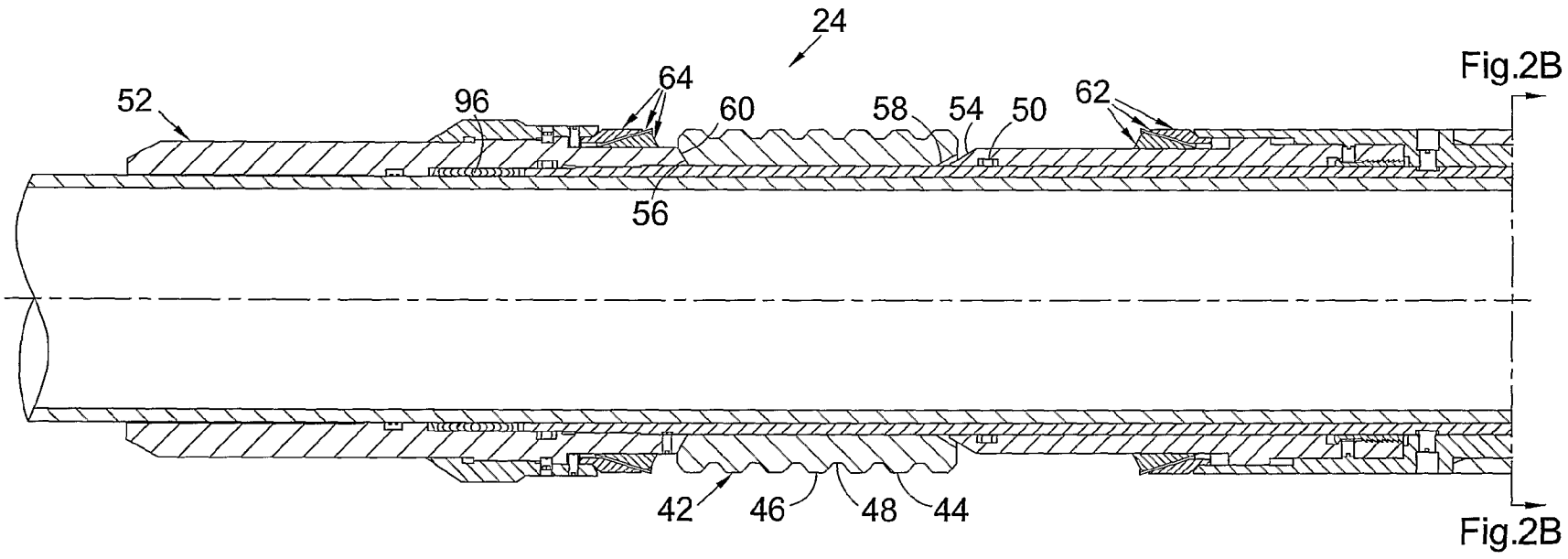
FIGS. 2A, 2B and 2C is an enlarged cross-sectional side views of one of the packers of FIG. 1.
Figure 2B:
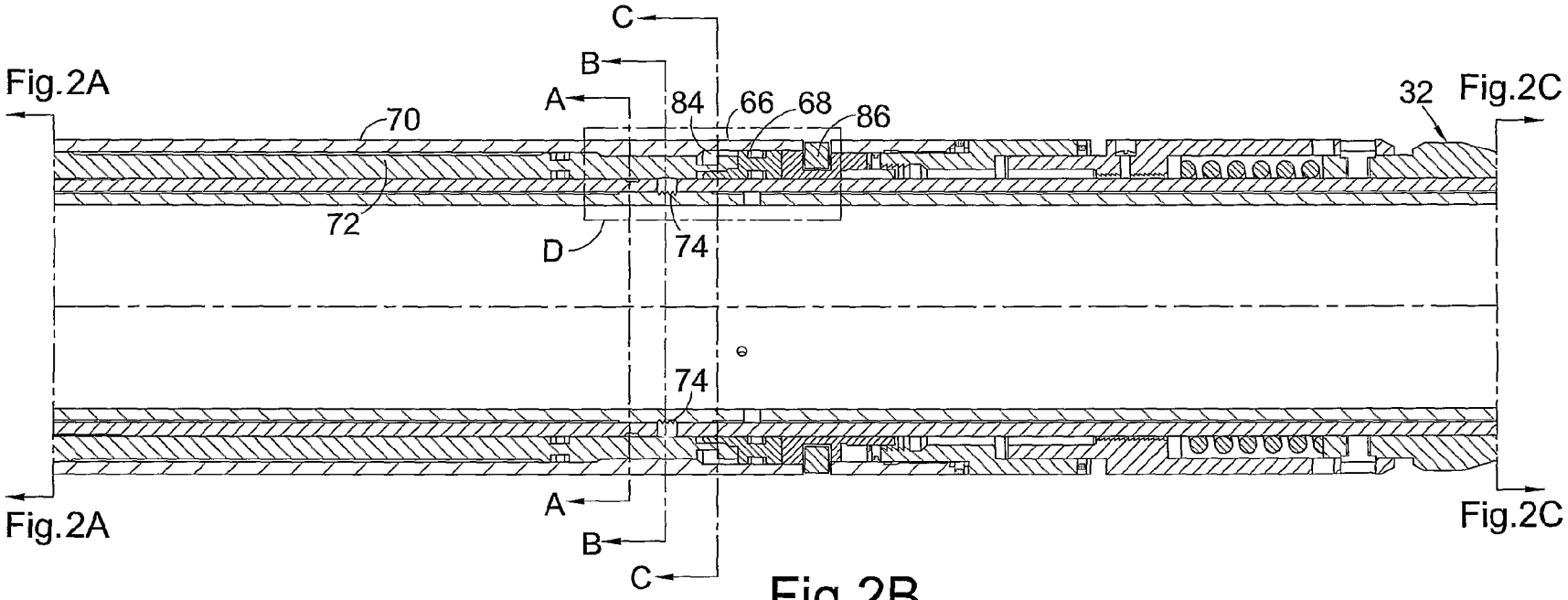
Figure 2C:
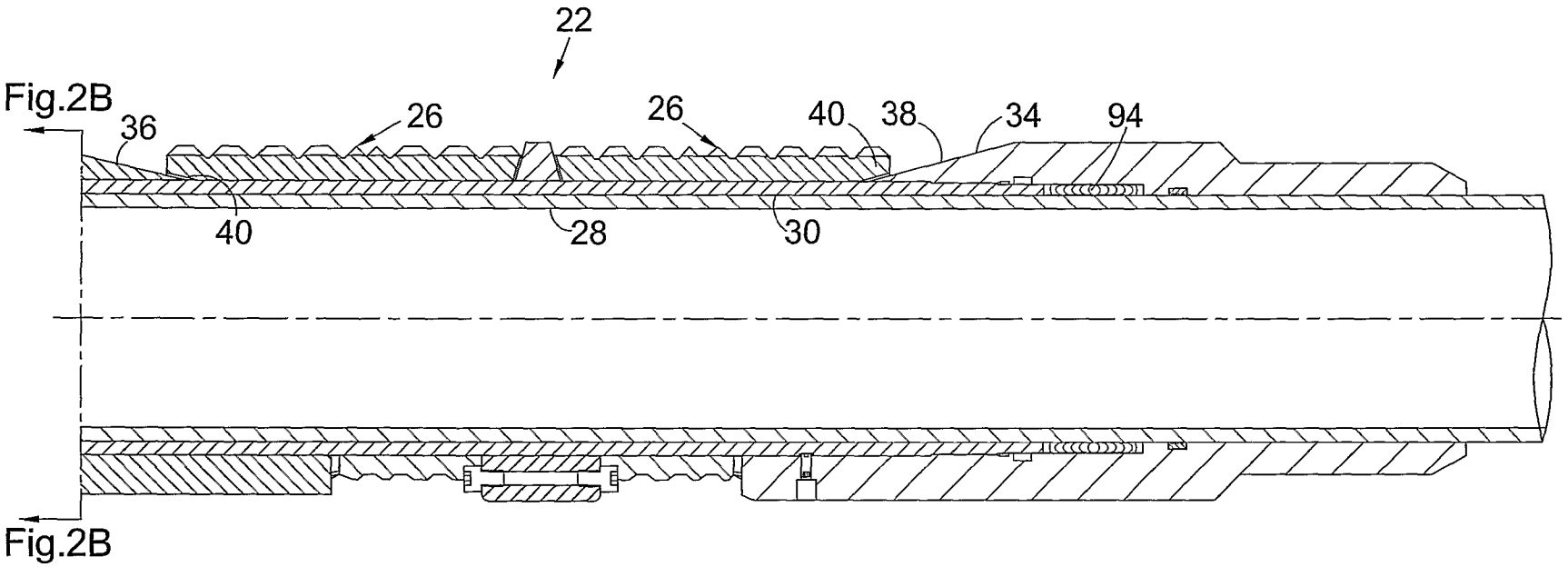

Referring now to FIGS. 2A, 2B and 2C, there is shown an enlarged cross-sectional side view of one of the packers 20 of FIG. 1 shown in a run-in configuration. As discussed, the packer 20 is intended for packing off against the surface of a formation.

The packer 20 includes anchoring means 22, packing means 24, an interlock 66 and a mandrel 28. The interlock 66 releasably maintains the packer 20 in the run-in configuration (shown more clearly in FIG. 5). Once the interlock 66 is deactivated the packer 20 moves to the set configuration (shown more clearly in FIG. 6).

The anchoring means 22 comprises six anchoring plates 26 arranged in pairs around the outer surface 30 of the mandrel 28. The anchoring means 22 further includes an axially moveable anchor ramp 32 and a stationary anchor ramp 34. When the interlock 66 is deactivated, as will be discussed in due course, the moveable anchor ramp 32 moves towards the stationary anchor ramp 34. The respective ramp surfaces 36, 38 engage complementary surfaces 40 on the underside of the anchoring plates 26, camming the plates 26 radially outwards from the mandrel 28.

As the stationary anchor ramp 34 does not move, there will also be some axial movement of the anchoring plates 26.

The packing means 24 comprises a nitrile rubber packing element 42 located circumferentially around the mandrel 28. The sealing surface 44 of the packing element 42 comprises a series of alternate ridges 46 and troughs 48. The packing means 24 further comprises a moveable packer ramp 50 and a stationary packer ramp 52.

The packer element 42 is set by deactivating the interlock 66. Once the interlock 66 is deactivated, the moveable packer ramp 50 moves axially towards the stationary packer ramp 52 and the respective ramp surfaces 54, 56 engage complementary cam surfaces 58, 60 on the packer element 42 camming the packer element 42 radially outwards from the mandrel 28.

The packer element 42 is then squeezed by the seal back-ups 62, 64. These back-ups 62, 64 prevent axial extrusion of the rubber element 42 as it engages the formation surface. This ensures a tight seal is formed by the sealing surface 44.

The operation and deactivation of the interlock 66 will now be described. The interlock 66 comprises a deactivation member 68, an anchoring means setting sleeve 70 and a packing means setting sleeve 72. The anchoring means setting sleeve 70 controls the movable anchor ramp 32 and the packing means setting sleeve 72 controls the movable packer ramp 50.

Figure 3A:
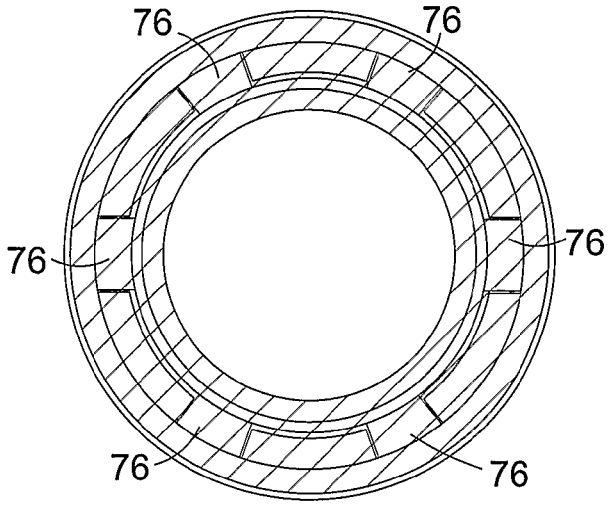
FIGS. 3A, 3B and 3C are cross-sectional views of the packer of FIG. 2 taken along sections lines A-A, B-B and C-C respectively.
Figure 3B:
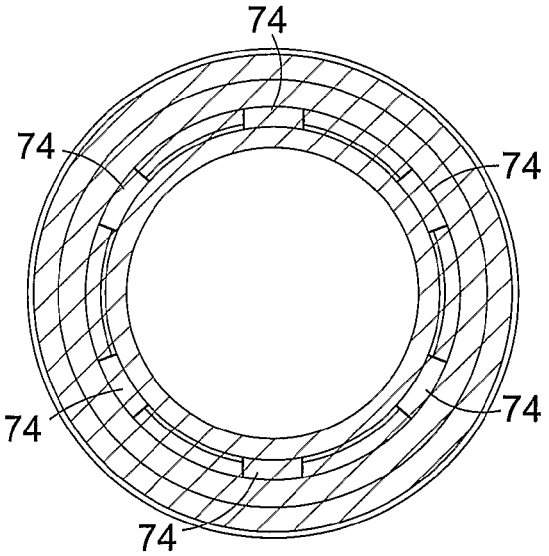
Figure 3C:
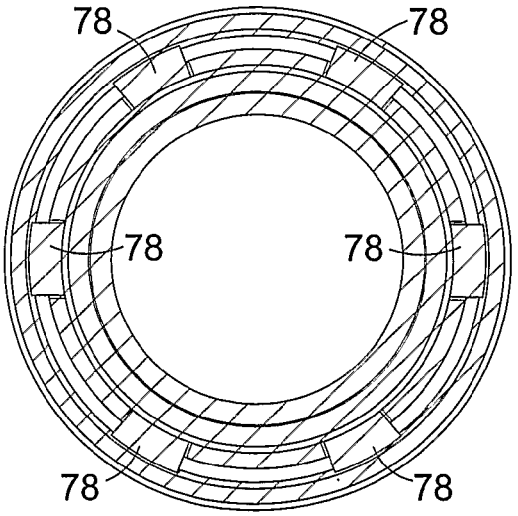

The interlock 66 also includes three sets of dogs, of which one, the mandrel dogs 74, is shown in FIG. 2B. The other dogs are a set of packing means setting sleeve dogs (or packing dogs) and a set of anchoring means setting sleeve dogs (or anchor dogs), which are not shown in FIG. 2. Each set of dogs comprises six dogs, radially spaced around the packer 20. Referring to FIG. 3, comprising FIGS. 3*a*-3*c*, there is shown a series of sectional views of the packer 20 of FIG. 2 taken along section lines A-A, B-B and C-C respectively.

FIG. 3*a* shows the six packing dogs 76, FIG. 3*b* shows the six mandrel dogs 74 and FIG. 3*c* shows the six anchor dogs 78.

As can be seen from FIG. 3, each set of dogs is radially displaced from the other sets of dogs, and any given section along the length of the interlock will only show dogs from one of these sets. However, for ease of understanding, FIG. 4 is an enlarged composite sectional view of detail D of FIG. 2 showing the interlock 66 with one dog from each of the three sets.

To deactivate the interlock 66, and set the packer 22, fluid is injected through a port 80 in the mandrel 28. This fluid flows along a path 82 through the interlock 66 and into a chamber 84 at one end of the deactivation member 68. Fluid is prevented from leaking from chamber 84 by O-ring seals 88. As fluid is pumped into the chamber 84, pressure builds and acts on the deactivation member 68. The pressure is resisted by a shear screw 86 which fixes the deactivation member 68 with respect to the anchoring means setting sleeve 70.

Once a predetermined pressure has been reached, the force on the deactivation member 68 applied by the fluid in the chamber 84 shears the shear screw 86 and the deactivation member 68 moves axially towards the anchoring means 22.

Figure 4:
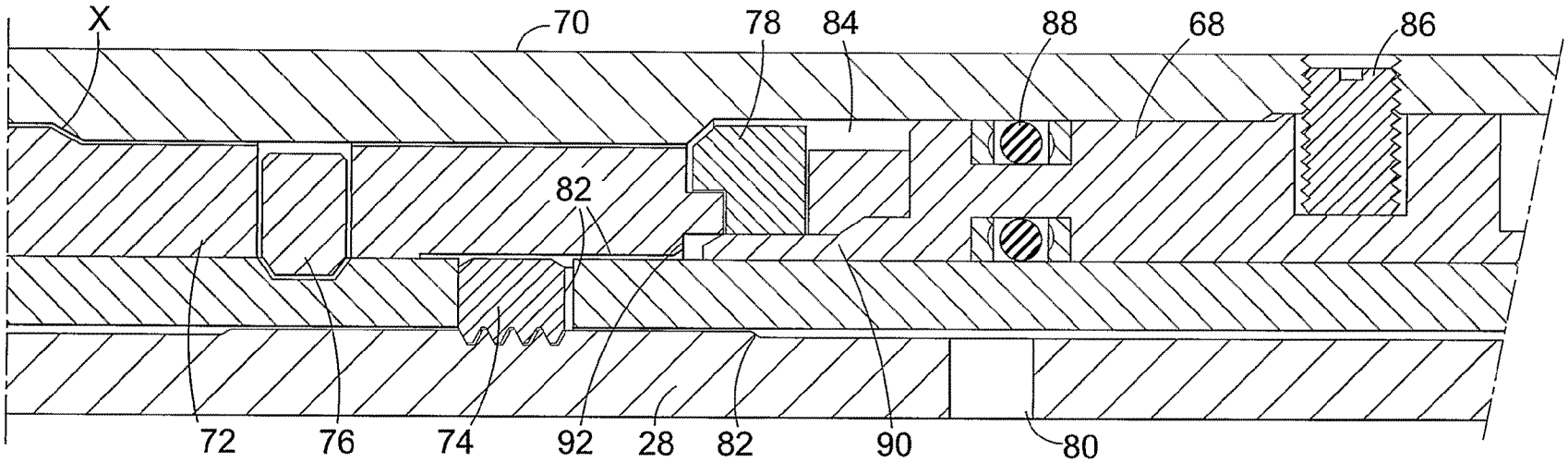
FIG. 4 is an enlarged composite sectional view of detail D of FIG. 2B.

The deactivation member 68 includes an extension piece 90 which, as shown in FIG. 4, engages the underside of the anchoring dog 78. The purpose of the anchoring dog 78 is to prevent the anchoring means setting sleeve 70 from setting the anchoring means 22 until the interlock 66 is deactivated. As the deactivation member 68 moves towards the anchoring means 22, the extension piece 90 disengages from the anchoring dog 78, releasing the dog 78, and, in turn, releasing the anchoring means setting sleeve 70.

Without the restraining force applied by the dog 78, the anchoring means setting sleeve 70 is displaced axially by the fluid pressure along the packer 20. The displacement of the setting sleeve 70 causes a displacement of the moveable anchor ramp 32, which results in the setting of the anchoring means 22 as described earlier.

The packing means setting sleeve 72 is prevented from setting the packing means by the packer dog 76 which is held in the position shown in FIG. 4 by the inner surface of the anchoring means setting sleeve 70. As the anchoring means 22 reaches the set position, and the anchoring means setting sleeve 70 reaches the extent of its travel, the internal diameter of the anchoring means setting sleeve 70 increases, indicated by point "X" on FIG. 4. This increase in the internal diameter provides a space for the packing dog 76 to move radially away from the mandrel 28. As the packing dog 76 is no longer restraining the packing means setting sleeve 72, the pressure applied to the setting sleeve 72 by the fluid in the chamber 84 displaces the dog 76 and the packing setting sleeve 72 moves towards the packing means 24. Movement of the packing setting sleeve 72 results in an equal movement of the moveable packing ramp 50 which sets the packing means 24, as previously described.

The final stage of the deactivation is the freeing of the mandrel 28. The mandrel 28 is held with respect to the other packer components by the mandrel dog 74. In the run-in configuration, the packing setting sleeve maintains the mandrel dog 74 in engagement with the mandrel 28. Once the interlock 66 is deactivated, and the packing setting sleeve 72 reaches the extent of its travel, the end 92 of the setting sleeve 72 passes over the mandrel dog 74 to free the dog 74 to move into the space left by the end 92 and the mandrel 28 is no longer restrained by the dog 74.

The packer 20 is now set, and the mandrel 28 is free to move with respect to the anchoring means 22 and the packing means 24.

The mandrel 28 can move up to 450 mm (18 inches) axially in either direction. During this movement, a seal is maintained between the mandrel 28 and the other packer components by a first chevron seal 94 located between the mandrel 28 and the stationary anchor ramp 34 and a second chevron seal 96 located between the mandrel 28 and the stationary packing ramp 52.

Figure 5:
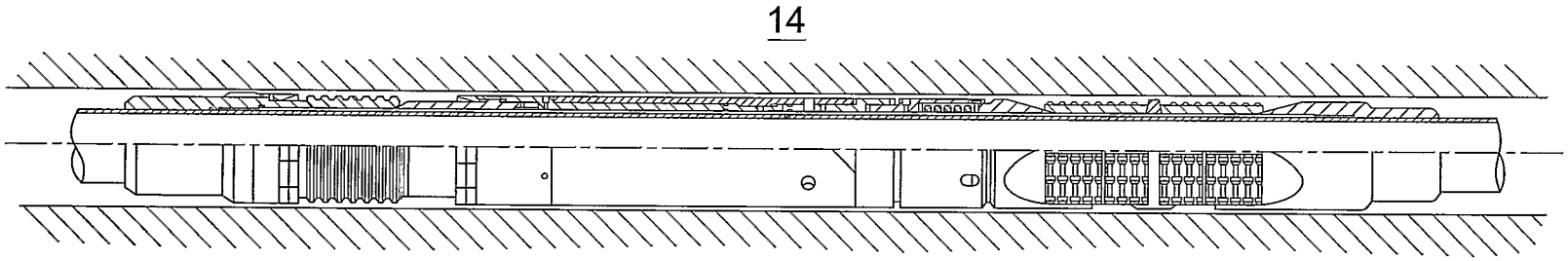
FIG. 5 is a partially cut-away view of a complete packer of FIG. 2, reduced in size, in the run-in configuration.
Figure 6:
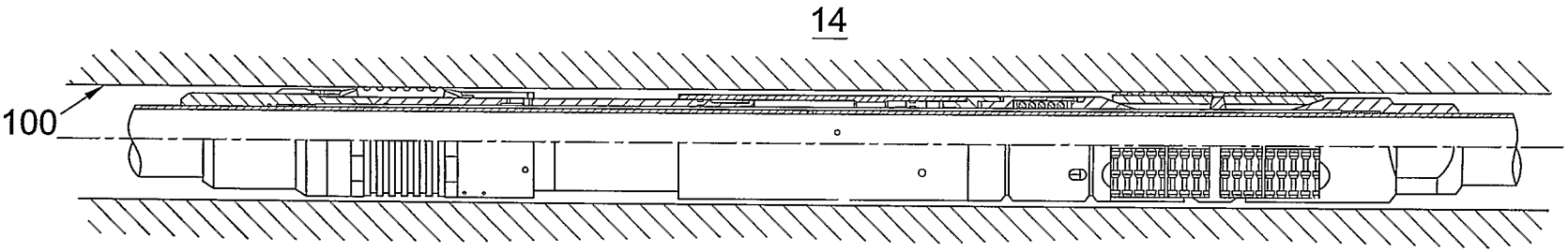
FIG. 6 is a view of a complete packer similar to FIG. 5, in the set configuration.

Referring now to FIGS. 5 and 6, there is shown partially cut-away views of the complete packer of FIG. 2 in the run-in and set configurations respectively. These Figures also show the formation 14 and, in the case of FIG. 6, the packer 20 engaging the formation surface 100.

Various modifications may be made to the embodiment described without departing from the scope of the invention. For example, the packer could include anchoring elements 26 which could be an integral packing element and anchoring element, that is an element which does both the packing and the anchoring. Furthermore although the embodiment shows an anchored seal being made with an open hole surface, it will be understood that the packer could be used in a cased hole. In such a circumstance, packer elements and anchor plates better suited to a cased hole could be used.

Those of skill in the art will recognise that the above described embodiment of the invention provides a packer which when set provides a seal which is not affected by movement of the mandrel caused by thermal fluctuations.

The invention claimed is:

1. A packer for a well comprising:

at least one packing element;

at least one anchoring element, and an interlock mechanism for controlling the sequential setting of first the at least one anchoring element and then the at least one packing element; and a mandrel coupled to the at least one anchoring element, wherein actuating the at least one anchoring element and the at least one packing element releases the mandrel to move with respect to the at least one packing element and the at least one anchoring element, and wherein the at least one packing element and the at least one anchoring element are integral, and the interlock mechanism comprises:

a deactivation element configured to move with respect to the mandrel upon application of a predetermined pressure;

a packer setting sleeve configured to move with respect to the mandrel from a packer run-in position to a packer set position;

a plurality of packer setting sleeve dogs for releasably retaining the packer setting sleeve in the packer run-in position; and a plurality of mandrel dogs for releasably retaining the mandrel with respect to the at least one integral packing/anchoring elements until said packing/anchoring elements are set.

2. A packer for a well comprising:

at least one packing element;

at least one anchoring element, and an interlock mechanism for controlling the sequential setting of first the at least one anchoring element and then the at least one packing element; and a mandrel coupled to the at least one anchoring element, wherein actuating the at least one anchoring element and the at least one packing element releases the mandrel to move with respect to the at least one packing element and the at least one anchoring element, and wherein the at least one packing element and the at least one anchoring element are separate, and the interlock mechanism comprises:

a deactivation element configured to move with respect to the mandrel upon application of a predetermined pressure;

an anchoring element setting sleeve configured to move with respect to the mandrel from an anchoring element run-in position to an anchoring element set position;

a plurality of anchoring element setting sleeve dogs for releasably retaining the anchoring element setting sleeve in the anchoring element run-in position;

a packing element setting sleeve configured to move with respect to the mandrel from a packing element run-in position to a packing element set position;

a plurality of packing element setting sleeve dogs for releasably retaining the packing element setting sleeve in the packing element run-in position; and a mandrel dog for releasably retaining the mandrel with respect to the packing and anchoring elements until said packing and anchoring elements are set.

3. A method of setting a packer in a well, the method comprising the steps of:

preventing the packer from setting until a predetermined fluid pressure is applied to an interlock mechanism; and then using the interlock mechanism to first allow at least one anchoring element to expand outwardly from a mandrel from a run-in configuration to create an anchored configuration with a surface of the well under the action of the applied fluid pressure; and then using the interlock mechanism to allow at least one packing element to expand outwardly from the mandrel from a run-in configuration to create a sealed configuration with a surface of the well under the action of the applied fluid pressure, wherein actuating the at least one anchoring element and the at least one packing element releases the mandrel to allow said mandrel to be moveable with respect to the at least one packing element and the at least one anchoring element.

4. A packer for a well comprising:

at least one packing element, at least one anchoring element, a mandrel, and an interlock mechanism;

wherein said mandrel is coupled to the at least one anchoring element, and wherein the mandrel can move axially by approximately 450 mm (18 inches) either up or down the well with respect to the packing and anchoring elements;

wherein the at least one packing element and the at least one anchoring element are integral;

wherein the interlock mechanism is for controlling the sequential setting of first the at least one anchoring element, and then the at least one packing element, said interlock mechanism further comprising:

a deactivation element configured to move with respect to the mandrel upon application of a predetermined pressure;

a packer setting sleeve configured to move with respect to the mandrel from a packer run-in position to a packer set position;

a plurality of packer setting sleeve dogs for releasably retaining the packer setting sleeve in the packer run-in position; and a plurality of mandrel dogs for releasably retaining the mandrel with respect to the at least one packing element and the at least one anchoring element until said at least one packing element and said at least one anchoring element are set; and wherein actuating the at least one packing element and the at least one anchoring element releases the mandrel to move with respect to the packing and anchoring elements.

5. A packer for a well comprising:

at least one packing element;

at least one anchoring element, and an interlock mechanism for controlling the sequential setting of first the at least one anchoring element and then the at least packing element; and a mandrel coupled to the at least one anchoring element, wherein actuating the at least one packing element and the at least one anchoring element releases the mandrel to move with respect to the at least one packing element and the at least one anchoring element, and wherein the interlock mechanism is configured to prevent the packer from setting until a predetermined fluid pressure is applied to the interlock mechanism.

6. The packer of claim 5, wherein the at least one anchoring element is separate from the at least one packing element.

7. The packer of claim 5, wherein the mandrel can move axially up and/or down the well with respect to the at least one packing element and the at least one anchoring elements.

8. The packer of claim 7, wherein the mandrel can move axially by approximately 450 mm (18 inches) either up or down the well.

9. The packer of claim 5, wherein the mandrel includes a port through which a pressure of sufficient magnitude to trip the interlock mechanism and set the packer can be applied.

10. The packer of claim 5, wherein the at least one packing element is an elastomer element.

11. The packer of claim 10, wherein the elastomer element is a nitrile rubber.

12. The packer of claim 10, wherein the elastomer element is solid.

13. The packer of claim 5, wherein the at least one packing element is in the form of a cup seal.

14. The packer of claim 5, wherein the at least one packing element comprises a seal surface, the seal surface defining alternate ridges and troughs.

15. The packer of claim 5, wherein the at least one packing element comprises a series of overlapping seal back-ups.

16. The packer of claim 5, wherein the at least one anchoring element is set by deactivating the interlock mechanism.

17. The packer of claim 5, wherein the at least one packing element is set by deactivating the interlock mechanism.

18. The packer of claim 5, wherein the at least one anchoring element is separate from the at least one packing element, and wherein the mandrel can move axially up and/or down the well with respect to the at least one packing element and the at least anchoring element.

* * * * *